US010332460B2

(12) United States Patent
Yoshiga

(10) Patent No.: US 10,332,460 B2
(45) Date of Patent: Jun. 25, 2019

(54) DISPLAY AND DRIVING METHOD THEREOF

(71) Applicant: Innolux Corporation, Miao-Li County (TW)

(72) Inventor: Masahiro Yoshiga, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 297 days.

(21) Appl. No.: 15/201,606

(22) Filed: Jul. 4, 2016

(65) Prior Publication Data

US 2018/0005591 A1 Jan. 4, 2018

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01); *G09G 3/3677* (2013.01); *G09G 3/3688* (2013.01); *G09G 3/3696* (2013.01); *G09G 2310/0251* (2013.01); *G09G 2320/0233* (2013.01); *G09G 2320/0247* (2013.01); *G09G 2320/103* (2013.01); *G09G 2330/021* (2013.01); *G09G 2340/0435* (2013.01)

(58) Field of Classification Search
CPC .. G09G 3/30; G09G 3/32; G09G 3/34; G09G 3/36; G09G 5/00; G09G 3/10; G09G 5/10; G06F 3/038; G06K 9/00; G02F 1/141
See application file for complete search history.

(56) References Cited

U.S. PATENT DOCUMENTS

| | | | | |
|---|---|---|---|---|
| 4,931,787 | A * | 6/1990 | Shannon | G02F 1/13624 345/100 |
| 6,115,018 | A * | 9/2000 | Okumura | G09G 3/3648 345/210 |
| 7,289,161 | B2 | 10/2007 | Yamakawa et al. | |
| 2008/0165108 | A1 | 7/2008 | Shen et al. | |
| 2014/0063076 | A1 | 3/2014 | Chen et al. | |
| 2015/0138249 | A1* | 5/2015 | Miyata | G09G 3/3614 345/690 |
| 2016/0035260 | A1* | 2/2016 | Kim | G09G 3/3614 345/212 |

* cited by examiner

*Primary Examiner* — Pegeman Karimi
(74) *Attorney, Agent, or Firm* — JCIPRNET

(57) ABSTRACT

A display including a pixel cell is provided. When the liquid crystal display is displaying a static image, the pixel cell is refreshed through a first period, a second period, and a third period in sequence. In the first period, the pixel cell is charged by a target voltage. In the second period, the pixel cell is charged by a post voltage. In the third period, the pixel cell is charged by a base voltage until next of the first period. The post voltage is between the target voltage and the base voltage. In addition, a driving method for a display is also provided.

10 Claims, 7 Drawing Sheets

DISPLAY AND DRIVING METHOD THEREOF

BACKGROUND OF THE INVENTION

1. Field of the Invention

The invention relates to a display and a driving method thereof, and in particular to a liquid crystal display and a driving method capable of reducing the flicker and improving the light intensity loss when a low frequency driving scheme is applied to a display when displaying a static image.

2. Description of Related Art

When a display is displaying a static image, it is preferable for the static image not to be refreshed as many times as a dynamic image, in order to reduce power consumption. Given this concern, a low frequency driving scheme is usually applied to the display to refresh a static image. For example, the liquid crystal display is driven at 10 Hz when a static image is displayed. In other words, in every 6 frames, the liquid crystal display is only driven during a frame and not driven during the rest 5 frames. Therefore, some driving ICs stop functioning for the duration of 5 frames, which lowers power consumption.

However, under a low frequency driving scheme, every time the pixel cell is refreshed, a visible flicker is generated, detracting from the image quality. The flicker is more obvious in low to middle gray levels, and especially in dark gray levels. In addition, the light intensity may lose, and not the same as that of a normal driving scheme.

In view of this problem, the purpose of the invention is to provide a new low frequency driving scheme which can reduce the flicker and improve the light intensity loss.

SUMMARY OF THE INVENTION

Accordingly, the invention is directed to a display and a driving method capable of reducing the flicker and improving the light intensity loss.

An embodiment of the invention provides a display, including a pixel cell. When the liquid crystal display is displaying a static image, the pixel cell is refreshed through a first period, a second period, and a third period in sequence. In the first period, the pixel cell is charged by a target voltage. In the second period, the pixel cell is charged by a post voltage. In the third period, the pixel cell is charged by a base voltage until next of the first period. The post voltage is between the target voltage and a base voltage.

An embodiment of the invention provides a driving method for a display including a pixel cell. The driving method includes: charging the pixel cell with a target voltage in a first period; charging the pixel cell with a post voltage in a second period following the first period; and charging the pixel cell with a base voltage in a third period following the second period. Starts from the first period to third period are repeated to continuously refresh a static image, and the post voltage is between the target voltage and the base voltage.

According to the above descriptions, in the embodiments of the invention, when the display is displaying a static image by a low frequency driving scheme, visible flicker is reduced and the light intensity loss is improved, such that the image quality is improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
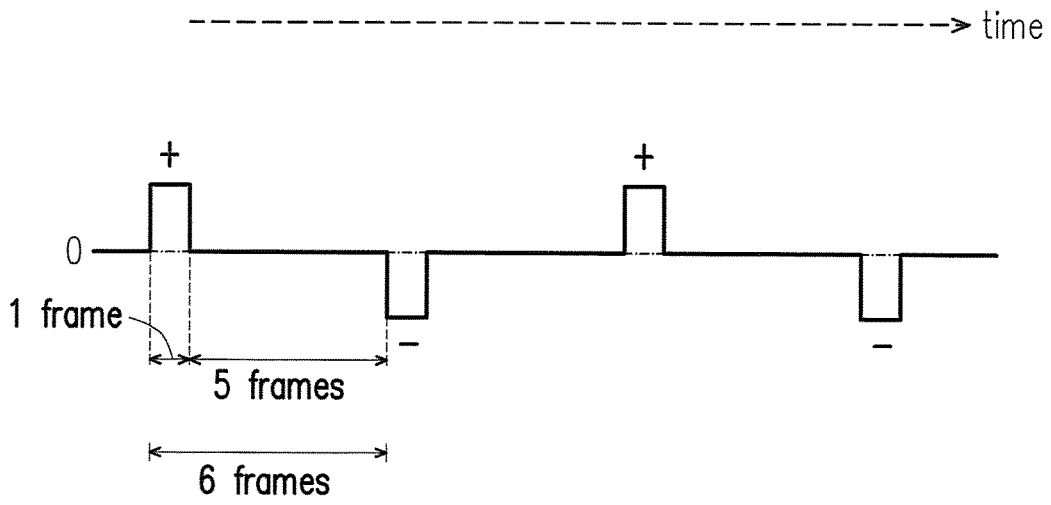
FIG. 1 is a diagram showing a related low frequency driving scheme with column inversion.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a diagram showing a frequency driving scheme with column inversion. When a liquid crystal display (LCD), an organic light emitting diode (OLED) display, an inorganic light emitting diode (LED) display, or other type of display uses low frequency driving scheme to display a static image, one driving waveform output from a source driver of the display is shown in FIG. 1. According to the driving waveform, a pixel cell is refreshed every 6 frames (also called a refresh period), wherein the pixel cell is charged in the first frame (also called a charge period) and is not charged in the following five frames (also called a suspend period). The polarity of the charge pulse (voltage signal or current signal) is inverted in each refresh period. Therefore, the display can save power when displaying a static image by lowering the driving frequency (in FIG. 1, the driving frequency is 10 Hz).

Figure 2:
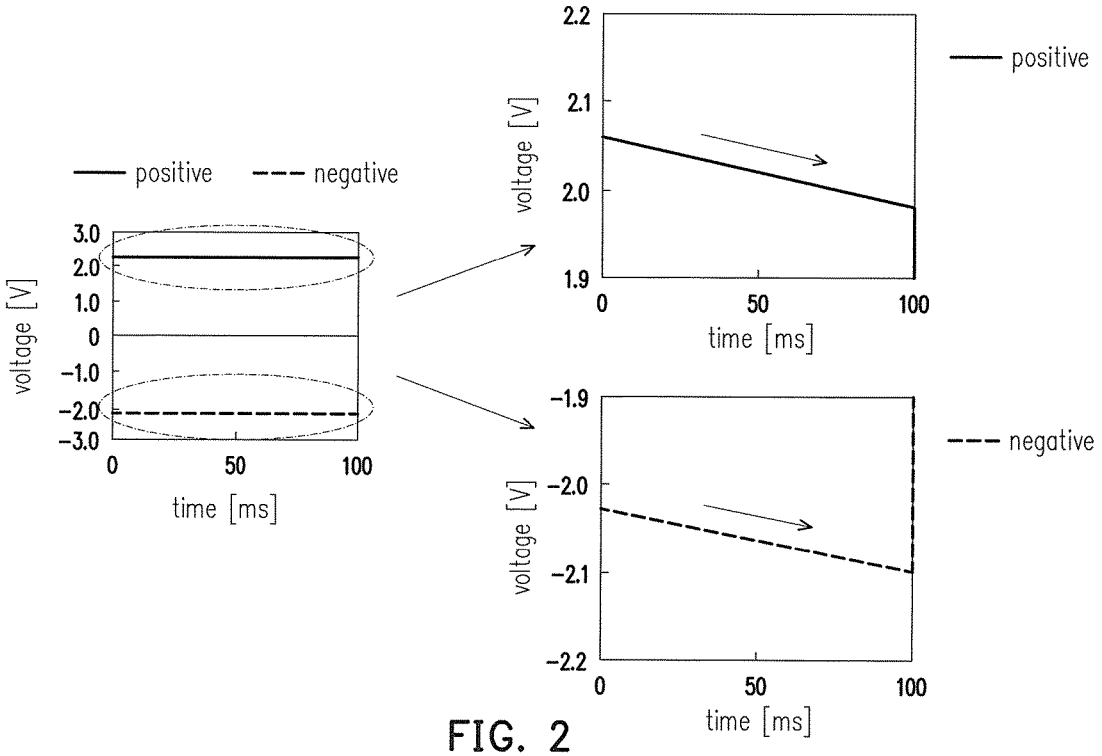
FIG. 2 is a diagram showing the pixel voltage change during the refresh period under the low frequency driving scheme shown in FIG. 1.

FIG. 2 is a diagram showing the pixel voltage change during the refresh period under the low frequency driving scheme shown in FIG. 1. When a display is driven at 60 frames per second, 100 ms is equal to 6 frames. Therefore, FIG. 2 shows the pixel voltage change during a refresh period shown in FIG. 1. Here, an n-channel (NMOS) TFT is connected to the pixel cell to control the timing when data is written into the pixel cell. During the refresh period, the n-channel TFT is applied with a negative voltage for gate terminal of the TFT to hold the pixel voltage. However, the pixel voltage still decreases slowly due to leakage current flowing between the gate and the channel of the n-channel TFT. Therefore, after a rapid charge to a desired pixel voltage, the pixel cell continuously decreases its pixel voltage during the refresh period. As shown in FIG. 2, the positive pixel voltage and the negative pixel voltage both decrease (from high to low) during the refresh period. At the time 100 ms (the beginning of the next refresh period), the positive pixel voltage rapidly changes to negative and the negative pixel voltage rapidly changes to positive.

Figure 3:
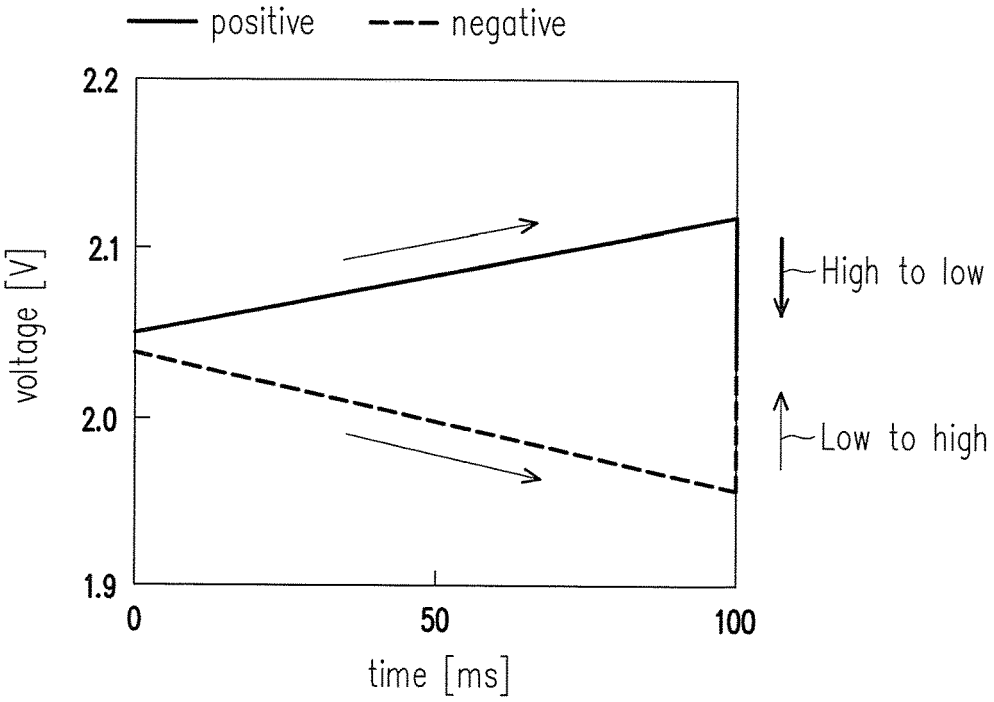
FIG. 3 is a diagram showing the voltage change across the pixel cell during the refresh period under the low frequency driving scheme shown in FIG. 1.

FIG. 2 shows only the pixel voltage change, but the orientation of the liquid crystal molecules are controlled by the voltage across the pixel cell rather than by the pixel voltage. Therefore, the voltage change across the pixel cell should be analyzed. The voltage across the pixel cell (also called an LC applied voltage VLC) is the absolute value of difference of the pixel voltage and the common voltage. Thus, the pixel voltage change across the pixel cell can be easily obtained from FIG. 2. FIG. 3 is a diagram showing the voltage change across the pixel cell during the refresh period under the low frequency driving scheme shown in FIG. 1. As shown in FIG. 3, when the pixel voltage is positive, the LC applied voltage VLC decreases slowly during the refresh period because of the leakage current and increases rapidly from low to high at time 100 ms because of the charge pulse signal. On the other hand, when the pixel voltage is negative, the LC applied voltage VLC increases slowly during the refresh period because of the leakage current and decreases rapidly from high to low at time 100 ms because of the charge pulse signal.

Figure 4:
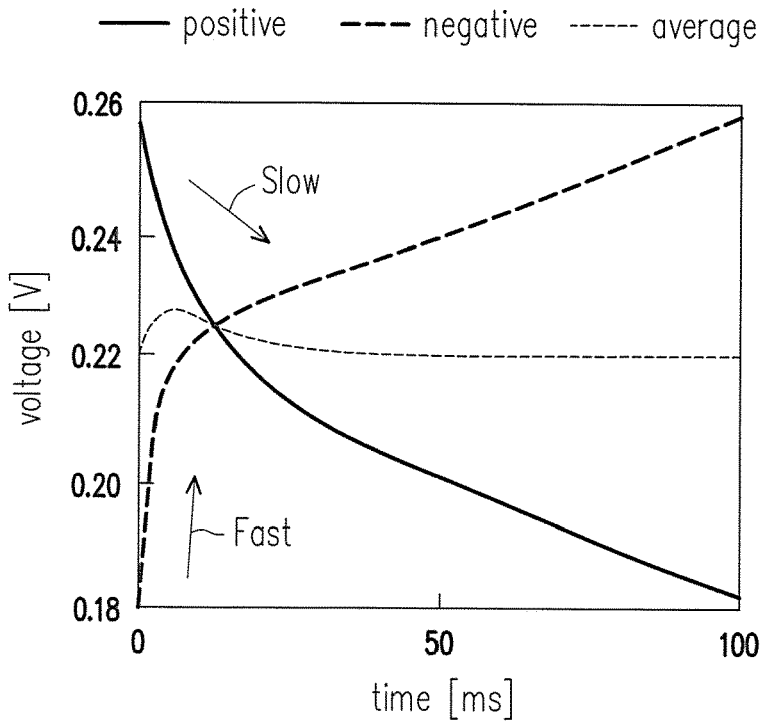
FIG. 4 is a diagram showing the light intensity change during the refresh period under the low frequency driving scheme shown in FIG. 1.

Next, the light intensity of the pixel cell during the refresh period under the low frequency driving scheme shown in FIG. 1 is analyzed. FIG. 4 is a diagram showing the light intensity change during the refresh period under the low frequency driving scheme shown in FIG. 1. The light intensity of the pixel cell is controlled by the orientation of the liquid crystal molecules and the orientation of the liquid crystal molecules is controlled by the electric field due to the LC applied voltage VLC. In this example, the light intensity becomes higher as the voltage increases and becomes lower as the voltage decrease. Therefore, when the pixel voltage is positive, the light intensity falls abruptly at the beginning of the refresh period due to the high-to-low pulse of the LC applied voltage VLC as shown in FIG. 3. Then the falling speed of the light intensity becomes slower due to the gradual decrease in the LC applied voltage VLC. On the other hand, when the pixel voltage is negative, the light intensity rises abruptly at the beginning of the refresh period due to the low-to-high pulse of the LC applied voltage VLC as shown in FIG. 3. Then the rising speed of the light intensity becomes slower due to the gradual increase in the LC applied voltage VLC.

However, the light intensity curves under the positive pixel voltage and the negative voltage are not symmetric, because the response characteristic of liquid crystal molecules to the LC applied voltage VLC is not linear. Especially, the low-to-high pulse of the LC applied voltage VLC changes the light intensity faster than the high-to-low pulse of the LC applied voltage VLC. Thus, an average curve of the light intensity curves under the positive pixel voltage and the negative pixel voltage has a ripple as shown in FIG. 4. The ripple brings a comparable change of the light intensity, and this change causes a visible flicker.

Figure 5A:
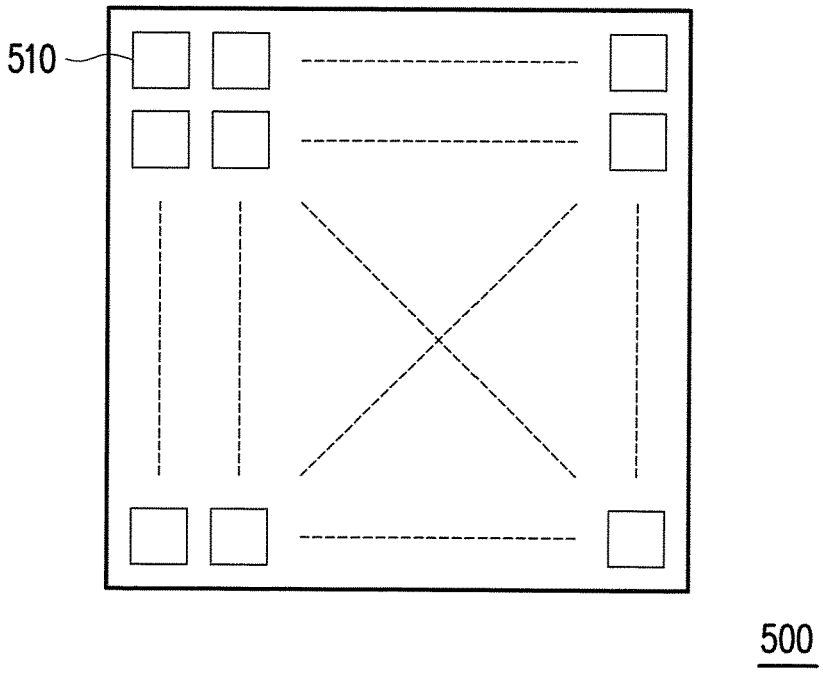
FIG. 5A is a diagram showing a display in accordance with an embodiment of the invention.
Figure 5B:
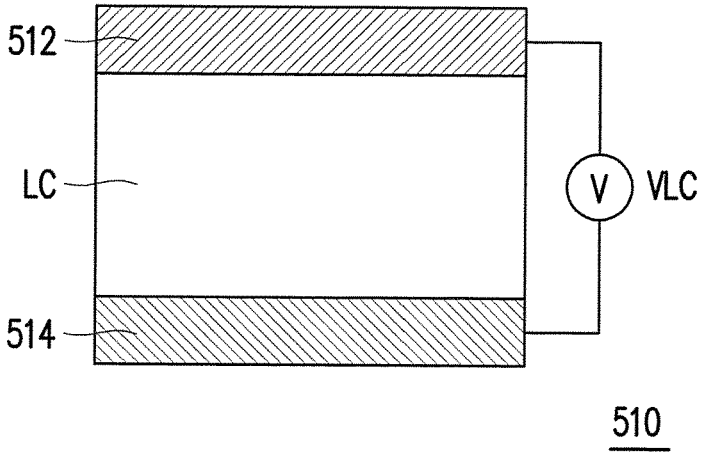
FIG. 5B is a diagram showing a pixel cell depicted in FIG. 5A in accordance with an embodiment of the invention.
Figure 6:
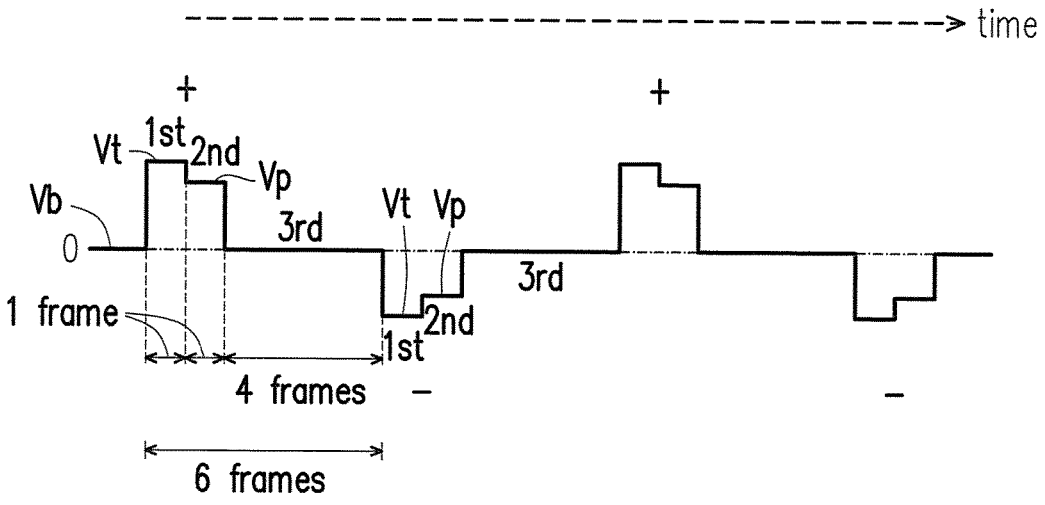
FIG. 6 is a diagram showing a low frequency driving scheme with column inversion in accordance with an embodiment of the invention.

FIG. 5A is a diagram showing a display in accordance with an embodiment of the invention. FIG. 5B is a diagram showing a pixel cell depicted in FIG. 5A in accordance with an embodiment of the invention. FIG. 6 is a diagram showing a low frequency driving scheme with column inversion in accordance with an embodiment of the invention. In the embodiment, the display 500 include at least one pixel cell 510 (a sub-pixel or a pixel). The pixel cell 510 is formed by a pair of electrodes 512 and 514 sandwiching a liquid crystal layer LC. In FIG. 6, the pixel cell 510 is refreshed every 6 frames. Thus, the refresh period is the same as the related low frequency driving scheme depicted in FIG. 1. However, there are at least two charge periods in each refresh period. As shown in FIG. 6, the refresh period includes a first period, a second period and a third period. The first period and the second period serve as two charge periods, and the third period serve as suspend period. In the embodiment, the third period is longer than the first period, and the third period is longer than the second period. The third period lasts for a plurality of frames, e.g. 4 frames.

In the embodiment, the pixel cell 510 is charged by a target voltage Vt in the first period and then charged by a post voltage Vp in the second period. The pixel cell 510 is charged by a base voltage Vb in the third period and remains until next first period. In the embodiment, the post voltage Vp is between the target voltage Vt and a base voltage Vb. The polarity of the charge pulses are inverted in each refresh period. In the embodiment, the target voltage Vt is greater than the base voltage Vb within a positive polarity state, and the target voltage Vt is less than the base voltage Vb within a negative polarity state. The target voltages Vt in two adjacent of the second periods have opposite polarities. Each post voltage Vp corresponds to a distinct target voltage Vt. In addition, the target voltage Vt could be greater than the post voltage Vp or smaller than the post voltage Vp, but the invention is not limited thereto. In an embodiment, the target voltage Vt may be equal to the post voltage Vp.

Figure 7:
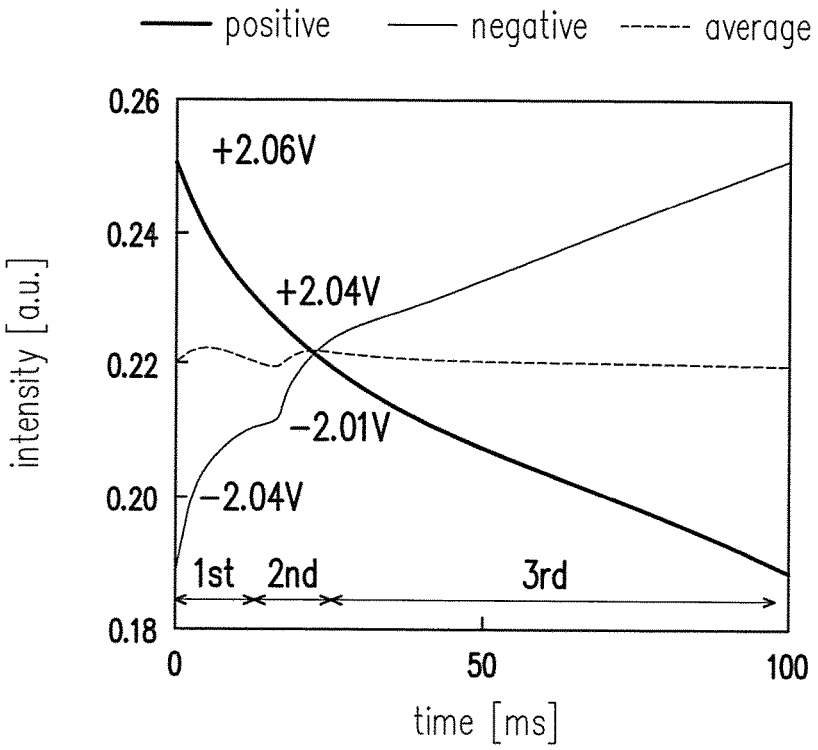
FIG. 7 is a diagram showing the pixel voltage change during the refresh period under the low frequency driving scheme shown in FIG. 6.

FIG. 7 is a diagram showing the pixel voltage change during the refresh period under the low frequency driving scheme shown in FIG. 6. Under the two-time charge scheme of the embodiment, the light intensity curve under the positive pixel voltage and the light intensity curve under the negative pixel voltage can be adjusted to be almost symmetric to each other. As shown in FIG. 7, the positive post voltage is +2.04V and the negative post voltage is −2.01V. The target voltage for the positive target voltage is set to +2.06V and the target voltage for the negative target voltage is set to −2.04V. By setting target voltages with different amplitudes for the positive target voltage and the negative target voltage respectively, the light intensity curve under the negative pixel voltage and the light intensity curve under the positive pixel voltage are adjusted to a different extent. In the embodiment, the slope of the light intensity curve under the negative pixel voltage is alleviated at the first two frames more than the slope of the light intensity curve under the positive pixel voltage. Consequently, the light intensity curve under the positive pixel voltage and the light intensity curve under the negative pixel voltage are close to symmetric, so that the average curve of the two light intensity curves has a smaller ripple than the average curve generated under the related driving scheme as depicted in FIG. 1. The ripple smaller brings little change of light intensity, and this change causes a flicker at an invisible level.

Figure 8:
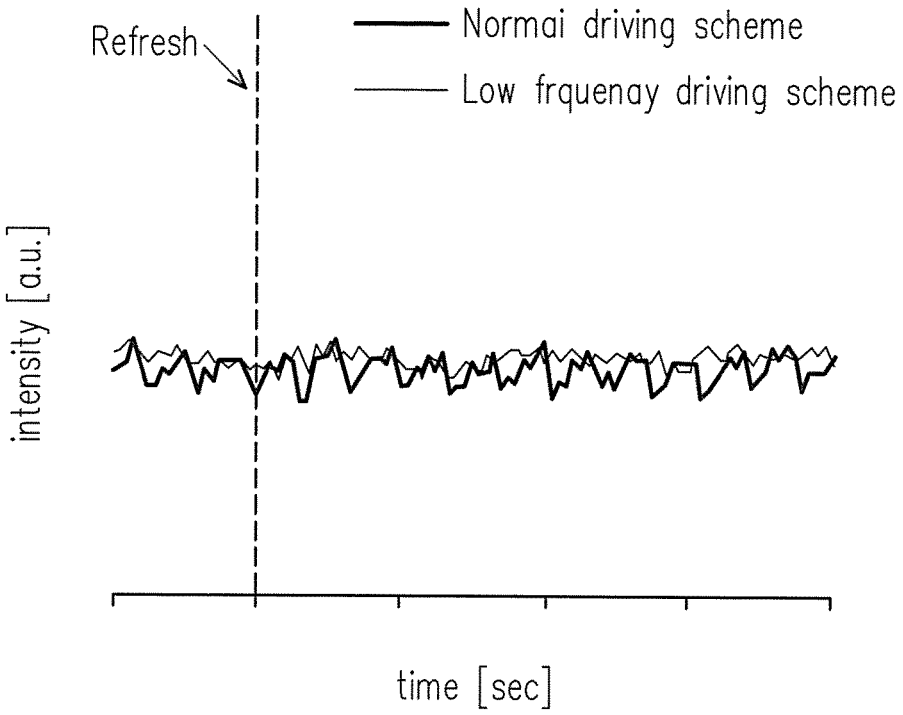
FIG. 8 is a diagram showing the luminance change of the liquid crystal driven by the low frequency driving scheme and the normal driving scheme in accordance with an embodiment of the invention.

FIG. 8 is a diagram showing the luminance change of the liquid crystal driven by the low frequency driving scheme and the normal driving scheme in accordance with an embodiment of the invention. From FIG. 8, it can be seen that the luminance change of the liquid crystal driven by the low frequency driving scheme is the same as that of the liquid crystal driven by the normal driving scheme, and the light intensity does not lose.

According to the exemplary embodiment, when the liquid crystal display is displaying a static image by low frequency driving scheme of the invention, visible flicker is reduced and light intensity is improved, such that the image quality is improved. The low frequency driving scheme of the invention is especially applicable to low-middle gray level static images. Because the flicker is more serious in low to middle gray levels, the improvement is more obvious.

Figure 9:
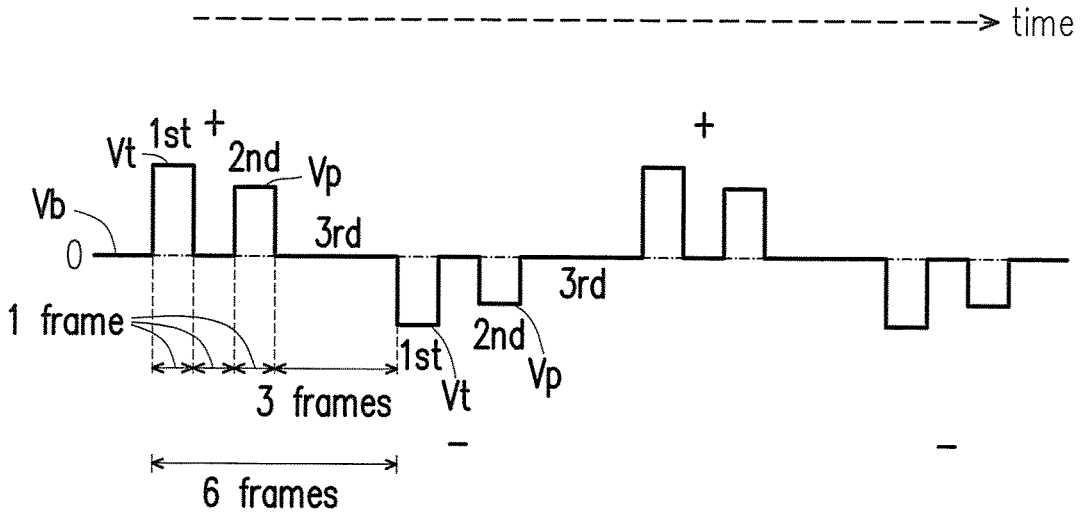
FIG. 9 is a diagram showing a low frequency driving scheme with column inversion in accordance with an embodiment of the invention.

FIG. 9 is a diagram showing a low frequency driving scheme with column inversion in accordance with an embodiment of the invention. Referring to FIG. 6 and FIG. 9, the low frequency driving scheme of the embodiment is similar to that of FIG. 9. A main difference therebetween, for example, lies in that a suspend period may be made between the first period and the second period. In the embodiment, the power consumption is the same as that of FIG. 6 because the charge number is two times, and the length of charging time and the amplitudes of the voltages.

Besides, the low frequency driving scheme described in the embodiment of the invention is sufficiently taught, suggested, and embodied in the embodiments illustrated in FIG. 6 to FIG. 8, and therefore no further description is provided herein.

Figure 10:
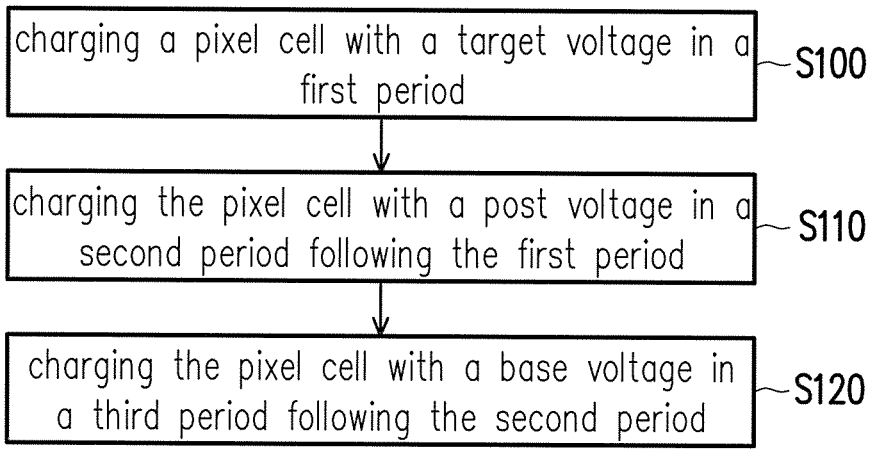
FIG. 10 is a diagram showing a driving method for a liquid crystal display in accordance with an embodiment of the invention.

FIG. 10 is a diagram showing a driving method for a liquid crystal display in accordance with an embodiment of the invention. Referring to FIG. 5A to FIG. 6 and FIG. 10, the driving method of the embodiment is at least adapted to the display 500 depicted in FIG. 5A and FIG. 5B, but the invention is not limited thereto. In step S100, the pixel cell 510 is charged with a target voltage Vt in a first period. In step S110, the pixel cell 510 is charged with a post voltage Vp in a second period following the first period. In step S120, the charging of the pixel cell 510 is stopped in a third period following the second period. In the embodiment, starts from the first period to third period are repeated to continuously refresh a static image, and the post voltage Vp is between the target voltage Vt and a base voltage Vb.

Besides, the driving method described in this embodiment of the invention is sufficiently taught, suggested, and embodied in the embodiments illustrated in FIG. 6 to FIG. 9, and therefore no further description is provided herein.

The above embodiments disclose a two-time charge scheme, but the number of charging of the pixel voltage during each refresh period is not limited to 2. There can be more than one frame for charging target voltages before the frame for charging a post voltage. Moreover, the low frequency driving scheme of the invention is performed only when the polarity of the charge voltage is inverted. The inversion type of the liquid crystal display is not limited to column inversion, and the low frequency, driving scheme of the invention is also applicable to dot inversion, row inversion, frame inversion, etc.

In the driving scheme of the invention, a pixel cell is charged at least two tunes during one refresh period. The target voltage is the gray level voltage which is applied to the pixel cell to output a gray level to be displayed. The post voltage is different from the gray level voltage. The low frequency driving scheme of the invention may be considered a kind of overdrive scheme, but there are several specific differences between them.

First and foremost, the overdrive scheme is used to shorten the response time of the liquid crystal molecules, so the amplitude of the overdrive voltage is always greater than the target voltage. However, in the driving scheme of the invention, as described in the previous paragraphs, the target voltage may be greater or smaller than the post voltage. As shown in FIG. 7, the target voltage (2.06V) for the positive target voltage is larger than the post voltage (2.04V), and the target voltage (−2.04V) for the negative target voltage is smaller than the post voltage (−2.01V).

Moreover, since the purpose of the overdrive scheme is to shorten the response time of the liquid crystal molecules, the overcharge period and the normal charge period are generally shorter than 1 frame. However, the driving scheme of the invention uses at least one frame for charging target voltage and one frame for charging post voltage. Thus, the driving scheme of the invention has a longer charge period than the overdrive scheme.

Last but not least, the low frequency driving scheme of the invention is only applied when the liquid crystal display is displaying a static image. When a static image is displayed, the input data for each pixel is not changed so a gray level is refreshed to the same gray level. Because the gray level is not changed, the orientation of the liquid crystal molecules is also not changed. Thus, under the overdrive scheme, it is not necessary to shorten the response time of the liquid crystal molecules, so the overcharge voltage is equal to the target voltage when the gray level is not changed. On the other hand, in the low frequency driving scheme of the invention, the target voltage is different from the post voltage even though the gray level is not changed.

Given the above points, the driving scheme of the invention is substantially different from an overdrive scheme.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display, comprising:

a pixel cell; and a source driver for driving the pixel cell, wherein when the display is displaying a static image, the pixel cell is refreshed by a waveform outputted from the source driver comprising a first period, a second period, and a third period in sequence, wherein in the first period, the pixel cell is charged by a target voltage;

in the second period, the pixel cell is charged by a post voltage; and in the third period, the pixel cell is charged by a base voltage, wherein the first period lasts within one frame time, the second period lasts within one frame time, the third period lasts for at least two frame times, the first period is less than the third period, and the second period is less than the third period, wherein the post voltage is between the target voltage and the base voltage.

2. The display as claimed in claim 1, wherein the first period lasts for one frame time, and the second period lasts for one frame time.

3. The display as claimed in claim 1, wherein the target voltage is greater than the base voltage within a positive polarity state, and the target voltage is less than the base voltage within a negative polarity state.

4. The display as claimed in claim 1, wherein the target voltages in two adjacent of the second periods have opposite polarities.

5. The display as claimed in claim 1, wherein the target voltage applied to the pixel cell to output a gray level.

6. A driving method for a display comprising a pixel cell and a source driver for driving the pixel cell, the driving method comprising:

outputting a waveform comprising a first period, a second period, and a third period in sequence from the source driver;

charging the pixel cell with a target voltage in a first period of the waveform;

charging the pixel cell with a post voltage in a second period of the waveform; and charging the pixel cell with a base voltage in a third period of the waveform, wherein the first period lasts within one frame time, the second period lasts within one frame time, the third period lasts for at least two frame times, the first period is less than the third period, and the second period is less than the third period, wherein starts from the first period to third period are repeated to continuously refresh a static image, and the post voltage is between the target voltage and the base voltage.

7. The driving method as claimed in claim 6, wherein the first period lasts for one frame time, and the second period lasts for one frame time.

8. The driving method as claimed in claim 6, wherein the target voltage is greater than the base voltage within a positive polarity state, and the target voltage is less than the base voltage within a negative polarity state.

9. The driving method as claimed in claim 6, wherein the target voltages in two adjacent of the second periods have opposite polarities.

10. The driving method as claimed in claim 6, wherein the target voltage applied to the pixel cell to output a grey level.

* * * * *